US006481061B1

(12) United States Patent
Andre et al.

(10) Patent No.: US 6,481,061 B1
(45) Date of Patent: Nov. 19, 2002

(54) CRIMPING RING AND METHOD FOR MAKING SAME

(75) Inventors: Michel Andre, Romorantin Lanthenay (FR); Pascal Detable, Gievres (FR); Gino Leze, Romorantin Lanthenay (FR)

(73) Assignee: Etablissements Caillau, Issy-les-Moulineaux (FR)

( * ) Notice: Subject to any disclaimer, the term of this patent is extended or adjusted under 35 U.S.C. 154(b) by 0 days.

(21) Appl. No.: 09/914,071

(22) PCT Filed: Feb. 25, 2000

(86) PCT No.: PCT/FR00/00470

§ 371 (c)(1),
(2), (4) Date: Aug. 23, 2001

(87) PCT Pub. No.: WO00/50183

PCT Pub. Date: Aug. 31, 2000

(30) Foreign Application Priority Data

Feb. 26, 1999 (FR) ..... 99 02477

(51) Int. Cl.[7] ..... B65D 63/00; F16B 2/00

(52) U.S. Cl. ..... 24/20 R; 24/20 EE; 24/20 W; 24/23 R; 24/23 EE; 24/23 W

(58) Field of Search ..... 24/20 R, 21, 22, 24/20 W, 20 CW, 20 EE, 23 W, 23 EE; 16/108

(56) References Cited

U.S. PATENT DOCUMENTS

| | | | | | |
|---|---|---|---|---|---|
| 210,560 | A | * | 12/1878 | Robertshaw | 24/20 R |
| 410,447 | A | * | 9/1889 | Rich | 24/20 R |
| 2,273,007 | A | * | 2/1942 | Cooper | 24/23 W |
| 2,760,262 | A | * | 8/1956 | Homan | 24/20 R |
| 5,185,908 | A | * | 2/1993 | Oetiker | 24/20 R |
| 5,857,659 | A | * | 1/1999 | Kato et al. | 24/20 CW |

FOREIGN PATENT DOCUMENTS

| | | |
|---|---|---|
| DE | 25 47 637 | 4/1977 |
| EP | 0 610 108 | 8/1994 |
| GB | 2 247 041 | 2/1992 |

* cited by examiner

*Primary Examiner*—Victor Sakran
(74) *Attorney, Agent, or Firm*—Nath & Associates PLLC; Gary M. Nath

(57) ABSTRACT

A crimping ring comprises a rolled-up piece of metal strip (10). A first connection means formed at the first end (12) comprises a first setback overlap surface (16) together with at least one female member (18) recessed from said first surface. A second connection means formed at the second end (14) comprises a second setback overlap surface (20) together with a male member (22) formed to project from said second surface. On connection, the male member (22) is engaged in the female member (18) and is fixed thereto, while the overlap surfaces (16, 20) are disposed one against the other so as to define a connection zone of thickness that is substantially equal to the thickness of the main portion of the strip.

14 Claims, 4 Drawing Sheets

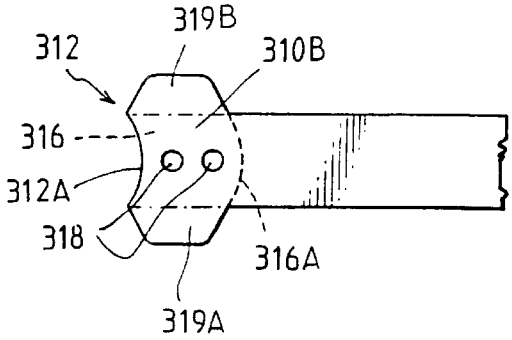
FIG.15
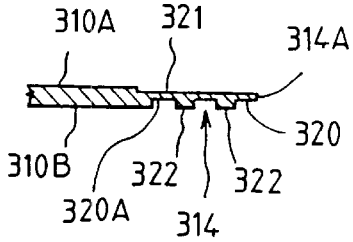
FIG.16
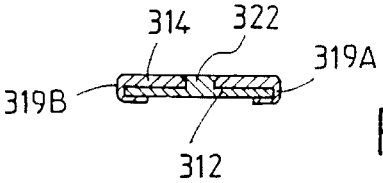
FIG.17
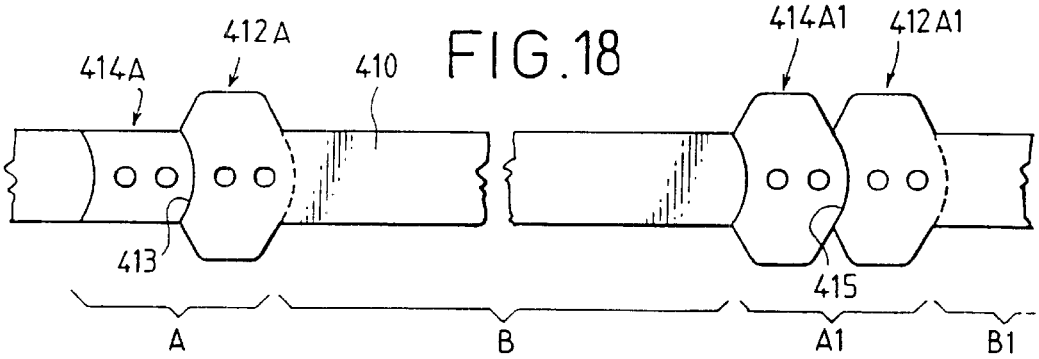
FIG.18
FIG.19
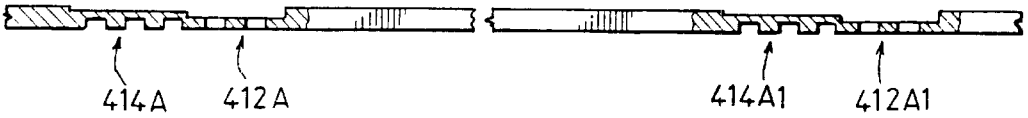

CRIMPING RING AND METHOD FOR MAKING SAME

The present invention relates to a crimping ring comprising a rolled-up piece of metal strip whose two ends include respective first and second connection means that co-operate with each other to interconnect said ends.

A crimping ring is known, e.g. from patent application GB 2 247 041, that is made from a rolled-up piece of metal strip, with the ends of the piece being cut out in such a manner as to present complementary profiles, for example one end having a T-shaped extension while the other end has a cutout of complementary shape. These ends are engaged one in the other and thereafter they need to be fixed together permanently, e.g. by welding.

A crimping ring is sometimes subjected to extremely high stresses, particularly during the crimping operation which is performed in order to obtain the desired degree of clamping around the object to be clamped, e.g. a bellows for a universal joint.

The type of connection mentioned above is poor at withstanding particularly high stresses, specifically when the stress acts in a direction other than the longitudinal direction of the strip. This applies in particular to stresses acting perpendicularly or substantially perpendicularly to the plane of the strip.

Document EP 0 610 108 discloses a crimping ring made from a metal strip whose ends are of a thickness that is close to half the thickness of the strip itself, and whose ends having fixing studs, for example. To connect those ends together, a fixing plate having holes, for example, is used with the plate being positioned so that the studs at the ends of the strip engage in the holes in the plate. Thereafter, the free ends of the studs are riveted to the plate.

That type of connection withstands relatively high stresses in satisfactory manner. However it suffers from the drawback of requiring the use of a piece that is separate from the piece of strip. The plate therefore needs to be machined separately, and stored appropriately in supply stores, and a tool must be provided enabling it to be put into place at the ends of the strip.

Thus the presence of such a plate increases the cost of the crimping ring.

Furthermore, when stresses act in the connection zone, reaction forces bear firstly between a first end of the strip and the plate, and secondly between the second end of the strip and the plate. In other words, these forces do not act to any significant extent between the two ends of the strip themselves. In some cases where stresses are particularly high, this can result in one end being slightly offset relative to the other.

An object of the present invention is to propose a crimping ring that is simple and inexpensive to make, and that is suitable for overcoming the above-mentioned drawbacks.

This object is achieved by the fact that the first connection means comprise a first overlap surface formed in the first end of the piece of strip as a setback from the first face of said piece of strip, together with at least one female member recessed from said first overlap surface, while the second connection means comprises a second overlap surface formed in the second end of the piece of strip as a setback from the second face of said piece of strip, together with a male member projecting from said second overlap surface, and in that the male member is engaged in the female member and fixed thereto while the overlap surfaces are placed one against the other so as to define a connection zone whose thickness is substantially equal to the thickness of the main portion of the piece of strip.

It will be understood that with the invention the two connected-together ends of the strip are in contact with each other via a relatively large area, corresponding to the areas of the overlap surfaces. As a result, the stresses acting in the connection zone apply to an area that is very considerably greater than for the crimping ring of document GB 2 247 041. This leads to much more uniform distribution of the stresses and to much greater strength in the connection zone.

In particular, since the overlap surfaces are placed one against the other, they provide a high level of resistance to stresses acting in a direction other than the longitudinal direction of the strip.

Compared with the crimping ring disclosed in document EP 0 610 108, the ring of the present invention presents the advantage of avoiding the presence of an additional plate. In addition, the connection establishes close and direct contact between the two ends of the strip.

Advantageously, at least one of the first and second overlap surfaces is formed in a setback which has a wedging rim, while the outline of the other one of the overlap surfaces presents a wedging edge co-operating with said rim to oppose forces directed transversely relative to the piece of strip.

The co-operation between the wedging edge and the wedging rim enables the connection to withstand forces acting substantially in the plane of the strip, but in a direction that crosses the longitudinal direction of the strip. This co-operation is additional to the engagement of the male member in the female member and increases the strength of the connection against stresses tending to cause the two ends of the strip to pivot about an axis corresponding to a diameter of the ring.

Advantageously, the female member is formed by a through opening in the piece of strip extending from the first overlap surface.

Thus, the female member(s) can be constituted merely by an opening or a notch formed in the end of the strip, e.g. by punching. The male member can pass through the opening and can be riveted into it.

The invention also provides a method of manufacturing a crimping ring in which first and second connection means are formed respectively at the first and second ends of a piece of metal strip, and in which these ends are connected together by making said first and second connection means co-operate with each other.

The invention seeks to provide a manufacturing method enabling a crimping ring to be made that overcomes the drawbacks of the cited prior art in simple manner.

This object is achieved by the fact that a first setback is formed in the first end of the piece of strip from the first face thereof, the surface of the first setback defining a first overlap surface, at least one female member is recessed from said first overlap surface, a second setback is formed in the second end of the piece of strip from the second face thereof, the surface of this second setback defining a second overlap surface, at least one male member is formed to project from said second overlap surface, the overlap surfaces are placed one against the other, the male member is engaged in the female member, and said male member is fixed to said female member, and in that the first and second setbacks are made in such a manner that the thickness of the ring in the connection zone defined by the overlap surfaces disposed one against the other is substantially equal to the thickness of the main portion of the piece of strip.

The setbacks at the two ends of the strip are made, for example, by localized stamping or embossing. As explained below, these setbacks can be made simultaneously or one after the other. In order to engage the male member in the female member, the two ends of the strip are brought together until they are overlapping. This can be done, for example, after a stage in which the piece of strip is rolled up.

Advantageously, a female member is made as a through hole in the piece of strip, the ends of the strip are connected together so that a male member appears in said female member, and said male member is deformed in order to be fixed to said female member.

The invention will be well understood and its advantages will appear more clearly on reading the following detailed description of embodiments given as non-limiting examples. The description refers to the accompanying drawings, in which:

FIG. 15 is a plan view of one end of a piece of strip in yet another variant;

FIG. 16 is a longitudinal section showing the other end of the piece of strip suitable for co-operating with the end shown in FIG. 15;

FIG. 17 is a cross-section showing the connection between the ends of FIGS. 15 and 16;

FIG. 18 is a fragmentary plan view of a metal strip during the manufacturing process in an advantageous implementation; and FIG. 19 is a partially cutaway side view of the strip shown in FIG. 18.

Figure 1:
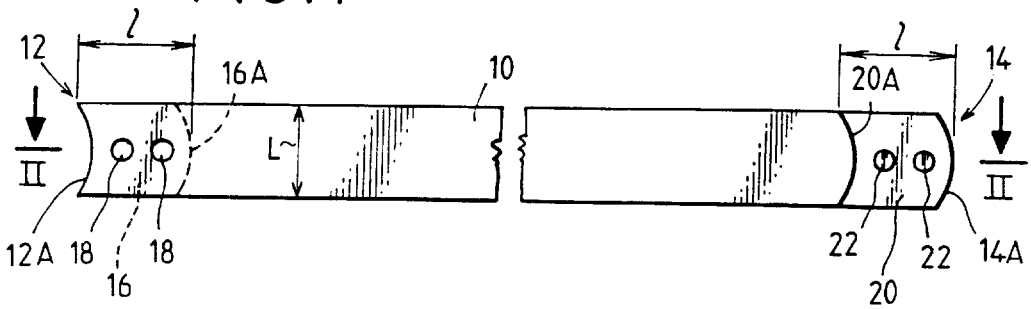
FIG. 1 is a plan view of a piece of metal strip whose two ends are shaped in such a manner as to present setbacks and the male and female members used for fixing the strip.
Figure 2:
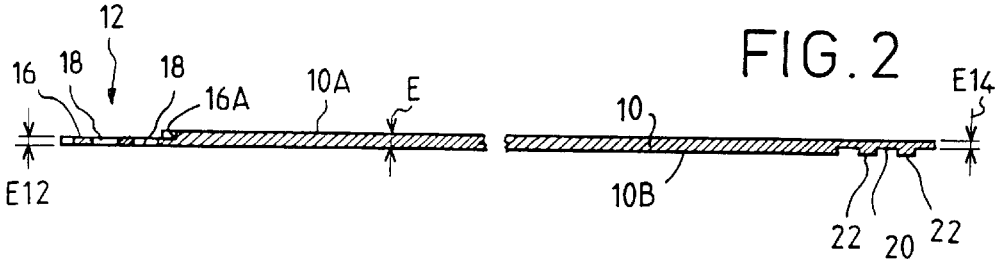
FIG. 2 is a section view on line II—II of FIG. 1.
Figure 3:
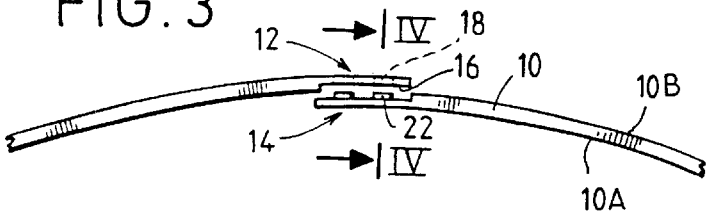
FIG. 3 is a fragmentary elevation view of a ring prior to interconnecting the two ends of the piece of strip constituting it.

FIG. 1 shows a piece of metal strip 10, e.g. of steel or aluminum, of the type suitable for making a crimping ring. By way of example, this strip is cut from a sheet and presents substantially constant thickness over its entire length, except at its ends. The two ends 12 and 14 of the strip have complementary connection means enabling them to be interconnected to close the strip and shape it into a crimping ring, as can be seen in FIG. 3.

The first connection means formed at the end 12 of the strip comprises a setback with solid portions forming a first overlap surface 16. Holes 18 are formed through this setback and constitute female connection members.

The end setback 12 is arranged so that the thickness E12 of said end is substantially equal to half the thickness E of the piece of strip.

The second connection means formed at the second end 14 of the strip likewise has a setback whose surface forms a second overlap surface 20.

Studs 22 project from this overlap surface, forming projecting male members. In FIG. 3 it can be seen that the studs 22 are designed to engage in the holes 18 to form a male-female connection.

Figure 4:
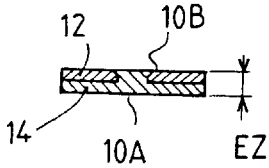
FIG. 4 is a section on a radial plane of the ring (on line IV—IV of FIG. 3) in the zone where the ends of the piece of strip are interconnected.

The setback which includes the surface 16 is made from the first face 10A of the piece of strip. It is thus this first face which is concave in the region of the setback. In contrast, the setback which includes the second overlap surface 20 is formed from the second face 10B of the strip. The thickness of this setback zone as measured between the face 10A and the overlap surface 20, and referenced E14 is likewise substantially equal to half the thickness E of the strip. Thus, when the two overlap surfaces are placed one against the other, as shown in FIG. 4, the total thickness EZ of the connection zone is substantially equal to the thickness E of the strip.

Each of the overlap surfaces 16 and 20 extends over the entire width L of the strip. At its side remote from the free edge 14A of the end 14, the overlap surface 20 presents a rim 20A which constitutes the transition between the main portion of the strip and the surface 20.

Similarly, the overlap surface 16 joins the main portion of the strip via a rim 16A located remotely from the free edge 12A of the end 12. The lengths l of the surfaces 16 and 20 are substantially equal (although allowance must be made for taking up slack associated with the ring being curved: the surface that is to be on the inside can be slightly shorter), so that when the two surfaces 16 and 20 are placed one against the other as in FIG. 3, the edge 14A comes to bear against the rim 16A, while the edge 12A comes to bear against the rim 20A.

The edge 14A and the rim 16A are complementary in shape. It can be seen that they are not rectilinear, but that they are slightly curved. This produces a wedging effect in the transverse direction extending across the longitudinal direction of the strip when the rim 16A is co-operating with the edge 14A. The same applies for co-operation between the edge 12A and the rim 20A.

The non-rectilinear shape of the rims 16 and 20 serves to distribute the change in thickness between the main portion of the strip and the setbacks over a region which extends over a fraction of the length of the strip. In other words, this change in thickness is caused to be more progressive than if it were constituted as a rectilinear step, thereby preventing it from causing excessive local weakening of the strip.

The male members constituted by the studs 22 can be shaped so as to present a height that is slightly greater than the thickness E12. Consequently, when the two ends of the piece of strip are connected together, these studs can project a little through the openings 18 beyond the face 10A, thus enabling them to be riveted against the face 10A of the piece of strip, as can be seen in FIG. 4.

Figure 6:
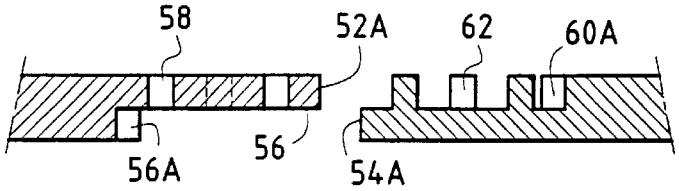
FIG. 6 is a section view on line VI—VI of FIG. 5.
Figure 5:
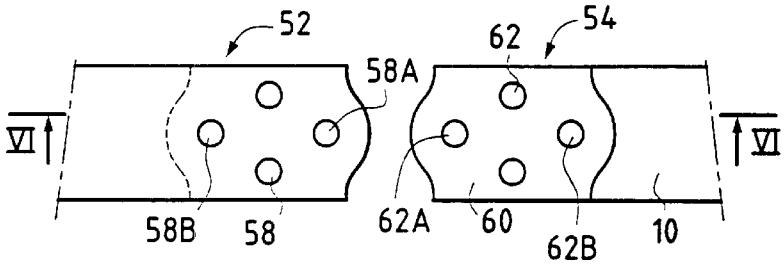
FIG. 5 is a plan view of the two ends of the piece of strip before they are interconnected, showing a variant embodiment.

The variant of FIGS. 5 and 6 is generally analogous to that of FIGS. 1 to 4 except that the first connection means shaped at the end 52 of the strip presents a larger number of openings 58 and the second connection means 54 shaped at the other end presents a larger number of studs 62. The studs are naturally located in such a manner as to be capable of engaging in the openings 58, with the exact positions of the studs and the openings being defined as a function of the desires of the person skilled in the art. For example, the studs and the openings in FIGS. 5 and 6 are disposed at the four corners of a lozenge.

As in FIGS. 1 to 4, the rim 56A of the overlap surface 56 remote from the free edge 52A of the first end of the strip is not rectilinear. The rim 56A constitutes a wedging rim suitable for co-operating with the free edge 54A of the second end, which is of matching shape, and the free edge 52A constitutes a wedging edge suitable for co-operating with the wedging rim 60A of the overlap surface 60.

As explained below, each of the connection means can be fitted with at least one male member and with at least one female member, these members being disposed in such a manner as to engage in one another so as to interconnect the ends of the strip. For example, in FIG. 5, the two orifices 58A and 58B in the vicinity of the two longitudinal ends of the surface 56 could be replaced by studs, while the two studs 62A and 62B could be replaced by openings for receiving said studs.

Figure 8:
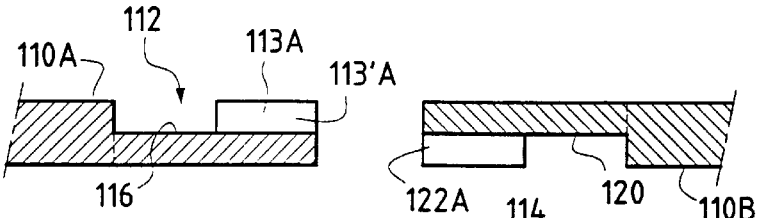
FIG. 8 is a section view on line VIII—VIII of FIG. 7.
Figure 7:
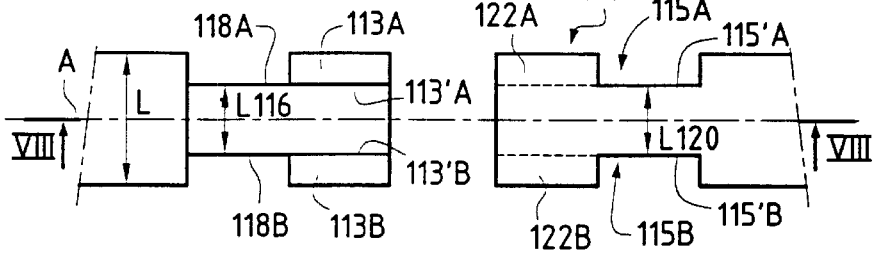
FIG. 7 is a plan view of the ends of the piece of strip before they are connected together, in another variant embodiment.

In the variant of FIGS. 7 and 8, the first connection means provided at the first end 112 of the piece of strip has a overlap surface 116 which extends over a width L116 that is less than the width L of the main portion of the strip. Similarly, the connection means provided at the end 114 of the piece of strip presents a second overlap surface 120 extending over a width L120 that is less than the width L of the strip.

The widths L116 and L120 are equal.

In the example shown in FIGS. 7 and 8, each of the connection means has two male members and two female members. For the connection means at the end 112, the female members are constituted by two notches respectively referenced 118A and 118B disposed on opposite sides of the overlap surface 116, in positions that are symmetrical about the longitudinal axis A of the piece of strip. For the second connection means at the end 114, the female members are likewise constituted by two analogous notches, respectively referenced 115A and 115B.

The male members are constituted by projecting portions likewise disposed on opposite sides of the overlap surfaces. Thus, the first connection means forms a tongue whose sides carry two projecting studs near its free end, respectively referenced 113A and 113B, which studs are preserved during the operation used for locally reducing the thickness of the end 112 when shaping the setback whose surface forms the overlap surface 116 (with the side notches advantageously being cut out during this operation). Similarly the second connection means forms a tongue whose free end has two side studs respectively referenced 122A and 122B shaped like the studs 113A and 113B.

It will be understood that when the ends of the strip in FIGS. 7 and 8 are assembled together, the overlap surfaces 116 and 120 are placed one against the other, with the studs 122A and 122B being received in the notches 118A and 118B while the studs 113A and 113B are received in the notches 115A and 115B. The connection means 112 and 114 are identical except that they are not formed in the same face of the piece of strip. In other words, the connection means 112 when seen from the first face 110A of the strip is identical to the second connection means 114 when seen from the second face 110B of the piece of strip.

In this embodiment, the faces 113'A and 113'B of the male members 113A and 113B that face towards the middle axis A of the piece of strip form wedging rims which cooperate with the longitudinal free edges 115'A and 115'B of the notches 115A and 115B to wedge the connection in the transverse direction. Similarly, the corresponding rims of the studs 122A and 122B perform the same function by co-operating with the longitudinal edges of the notches 118A and 118B.

Once the overlap surfaces have been put into place one against the other and the studs have been engaged in the notches, the connection can finally be bonded together by lightly deforming the studs, e.g. by clamping tending to move the two studs of either end towards each other. This deformation can also consist in flattening the studs in the radial direction so as to cause their free ends to partially overlie the adjacent face of the piece of strip (the face 110A far from the surface 120 for the ends of the studs 113A and 113B, and the face 110B far from the surface 116 for the ends of the studs 122A and 122B). The heights of the studs and the thicknesses of the setback portions are such that the total thickness of the connection, once made, remains substantially equal to the thickness of the main portion of the strip.

Figure 10:
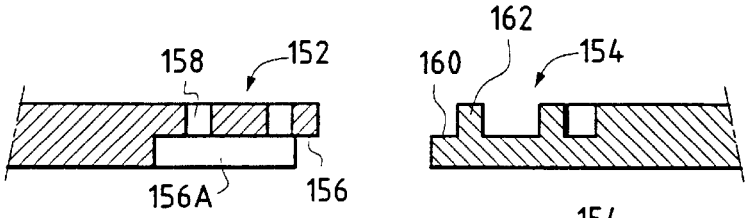
FIG. 10 is a section view on line X—X of FIG. 9.
Figure 9:
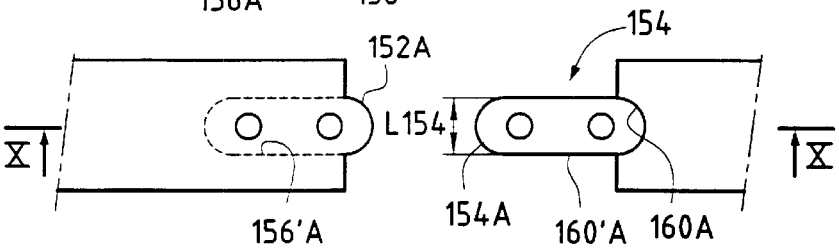
FIG. 9 is a plan view of the two ends of a piece of strip before they are connected together in another variant embodiment.

In the variant of FIGS. 9 and 10, it can be seen that the first connection means 152 has openings 158 analogous to the openings 18 and 58 described above, while the second connection means 154 has studs 162 analogous to the studs 22 or 62.

This time, the second connection means 154 is so shaped that, when seen from above, it presents the form of a tongue of width L154 that is smaller than the width of the piece of strip. Thus, the overlap surface 160 from which the studs 162 project extends over a fraction only of the width of the strip. Similarly, the overlap surface 156 in which the openings 158 are formed covers only a fraction of the width of the strip, and the outlines of the surfaces 160 and 156 are analogous.

Consequently, the rim 156A of the overlap surface 156 not only presents an end wall remote from the free edge 152A of the end 152, but also side walls 156'A extending generally along the longitudinal direction of the strip. When the two ends are connected together, the longitudinally extending edges 160'A of the overlap surface 160 form wedging edges that co-operate with the side walls 156'A so as to wedge the connection in the transverse direction of the strip.

Apart from these dispositions, the free edge 152A can be convex in shape suitable for co-operating with the rim 160A of the surface 160 remote from the free edge 154A of the tongue which carries the second connection means. As for the variants shown in FIGS. 1 to 6, the variant shown in FIGS. 9 and 10 could be modified so that each of the connection means has at least one stud and at least one female member.

Figure 12:
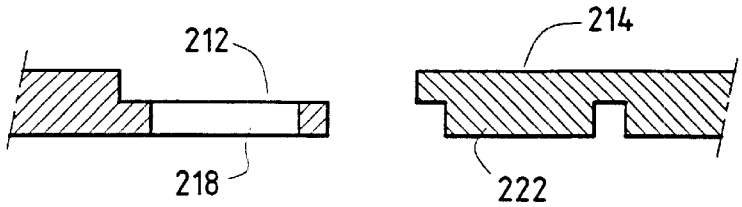
FIG. 12 is a section view on line XII—XII of FIG. 11.
Figure 11:
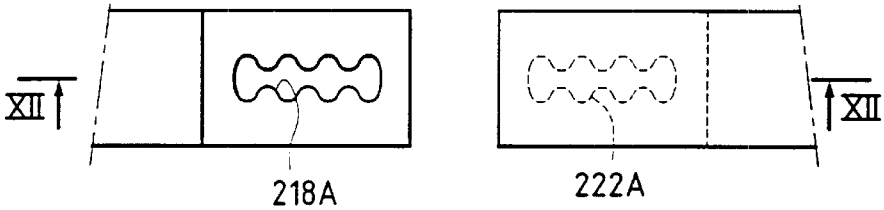
FIG. 11 is a plan view of the ends of a strip before they are connected together in yet another variant.

In the variant of FIGS. 11 and 12, the first connection means formed at the end 212 of the piece of strip has a single female member constituted by a slot 218 of relatively large size. The second connection means at the end 214 has a single male member 222 of corresponding size. Depending on the desired result in terms of strength of the connection, it can be preferable to replace the substantially cylindrical studs of the type represented by the studs 22 in FIG. 1 by a single stud of a different geometrical shape, e.g. an oblong stud, and correspondingly to replace the openings 18 by a single opening of matching dimensions. It can be desirable for the outline of this stud and of this opening to be given a particular geometrical shape, as is the case in FIGS. 10 and 11, where the stud 222 and the opening 218 have sinuous outlines respectively referenced 222A and 218A. The person skilled in the art can determine a suitable geometrical shape for the outline of the male member(s) and the female member(s) so as to increase the contact areas between said male and female members and direct the stresses that act between these members along desired directions.

Figure 13:
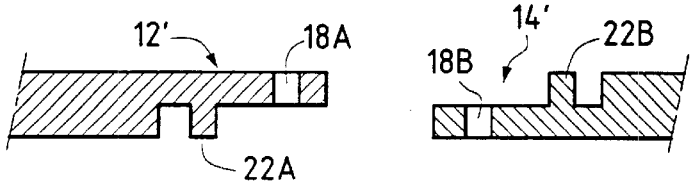
FIG. 13 is a longitudinal section view through the ends of a piece of strip in another variant, before they are connected together.

FIG. 13 shows a variant which differs from the embodiments of FIGS. 1 to 4 in that each connection means has one stud and one opening, respectively a stud 22A and an opening 18A for the first connection means 12', and a stud 22B suitable for engaging in the opening 18A, and an opening 18B suitable for receiving the stud 22A for the second connection means 14'.

To make the connection between the two ends of the strip in the variant described above with reference to FIGS. 1 to 13, the two overlap surfaces defined in the setbacks at each of the two ends of the strip are placed one against the other, and the male and female members are mutually engaged. Thereafter, the male members are fixed to the female members, e.g. by riveting.

In the variant shown, the ends of the strip in the setback regions are of constant thickness, equal substantially to half the thickness of the main portion of the strip. Nevertheless, it is possible for the thicknesses of these ends in the setback regions to vary, e.g. in the form of steps or otherwise. The setbacks can be shaped by a stamping and/or embossing operation tending to flatten the strip locally with excess matter being pressed out, e.g. sideways, while leaving unflattened portions to constitute the male members and embossing locally to greater depths in order to form the female members, or forming through holes e.g. by punching.

The piece of strip used for making the crimping ring can be obtained by being cut out from a continuous strip.

It is then possible to begin by cutting off the piece of strip from said continuous strip prior to making the first and second connection means.

Alternatively, it can be preferred to make at least some of the connection means in the continuous strip prior to splitting it up into pieces of strip having said connection means.

In either case, it can be desired to make the first and second connection means completely prior to interconnecting the two ends of the strip and fixing the male members in the female members.

Alternatively, it may be preferred to make the male members in part only or not at all prior to connecting the two ends of the strip together so as to place the two overlap surfaces one on the other, with the male members being formed only once the strip is in this position. Under such circumstances, after the first connection means have been formed with its first overlap surface and the female member, this first overlap surface is placed against the second end of the piece of strip and pressure is applied in the region of the overlapping ends of the piece of strip in order to cause material constituting the second end of the piece of strip to be pressed out with a male member being embossed in said female member.

Figure 14:
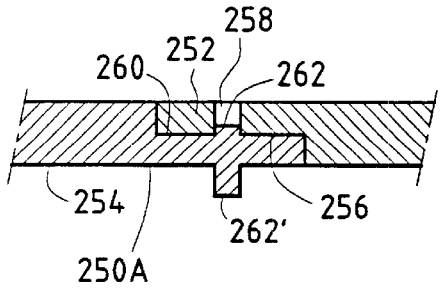
FIG. 14 is a longitudinal section view of the two ends of a piece of strip while they are being connected together in yet another variant.

In particular, FIG. 14 shows a variant in which the first connection means 252 is formed with the first overlap surface 256 and the female member constituted by a hole 258. The second connection means 254 is formed merely as a second overlap surface 260 and the beginning of a male member 262 so as to define a very shallow projection from said overlap surface 260.

FIG. 14 shows the situation in which the two overlap surfaces 256 and 260 have been placed against each other with the beginning of a male member 262 being in register with the female member 258 (into which it penetrates a short distance).

It can be seen that the second end of the strip presents a local excess quantity of material on its face 250A remote from the second overlap surface. In the example shown, this excess material is shaped as a stud 262' which is in alignment with the beginning of a male member 262 on an axis perpendicular to the plane of the strip.

The first overlap surface 260 is generally obtained by stamping or embossing giving rise to local flattening with the flattened material being pressed out, so that by suitably arranging the embossing tool and backing tool, it is possible to select the most favorable position for this local excess quantity of material. It can be constituted, for example, by a local increase in thickness.

In the situation shown in FIG. 14, it suffices to apply sufficiently strong pressure to the side 250A of the second end remote from the second overlap surface 260 in order to terminate formation of the male member by causing it to penetrate into the female member where necessary, treatment, such as heat treatment or quenching, can be initially applied to one of the two ends of the strip so as to ensure that the mechanical strength of the first end 252 is greater than that of the second end 254 in order to avoid said second end 252 being flattened when pressure is exerted to cause the male member to penetrate into the female member.

In the embodiments described above, the female members are made as through openings in the piece of strip, and the ends of the strip are connected together so that a male member is received in the female member and then said male member is deformed, e.g. by riveting as in FIG. 4, so as to fix it to said female member.

In FIG. 15, there can be seen the first connection means at the end 312 of a variant piece of strip. This first connection means is of the same type as the first connection means shown in FIG. 1, with elements referenced 316, 318, 312A, and 316A being analogous to the elements referenced 16, 18, 12A, and 16A, respectively.

As mentioned above, the setback whose surface forms the first overlap surface 316 can be made by locally flattening the end of the strip causing material to be pressed out in a controlled direction depending on the shape of the tool and the backing tool used. In FIG. 15, this material is directed outwards from the two longitudinally extending sides of the strip so as to form two side fins given respective references 319A and 319B disposed on either side of the overlap surface 316. On their faces remote from the overlap surface 316, the backs of these fins lie in the same general plane as the face 310B of the strip. The thickness of the strip in the setback region as measured between the face 310B and the overlap surface 316 is substantially about half the thickness of the main portion of the strip. The thickness of the fins is preferably less than that, e.g. about one-fourth the thickness of the main portion of the strip.

FIG. 16 shows the connection means at the second end 314 of the strip. It is analogous to the means 14 in FIG. 2, with the elements referenced 320, 322, 314A, and 320A corresponding respectively to the elements referenced 20, 22, 14A, and 20A. Thus, seen from the face 310B of the piece of strip, the second connection means is analogous to that of FIG. 1.

In contrast, seen from the face 310A of the piece of strip which is remote from the overlap surface 320, the second end of the strip has a step 321 whose depth is about one-fourth the thickness of the strip, for example. In this case, the thickness of the region of the strip defined between the bottom of this step and the overlap surface 320 is itself substantially equal to one-fourth the thickness of the main portion of the piece of strip. In FIG. 17, it can be seen that the two ends of FIGS. 15 and 16 are assembled together by placing the two overlap surfaces 316 and 320 one on the other, engaging the male members 322 in the openings 318, and then folding the fins 319A and 319B into the recess(es) formed by the step(s) 321. In the example shown, the male members are also riveted in the female members. In FIG. 17, the step 321 covers the entire width of the strip, but that is not always necessary, it suffices for the strip to have two steps 321 suitable for receiving the folded-over fins 319A and 319B, and having substantially complementary shapes.

Alternatively, the first or the second end of the piece of strip could be provided with side fins analogous to the fins 319A and 319B without forming a step analogous to the step 321 in the other end. As a result, folding-over the fins tends to clamp the end of the strip which does not have fins and gives rise to local extra thicknesses of the strip in the connection zone. If the fins are of relatively small thickness, e.g. about one-fourth the thickness of the main portion of the strip, it will often be the case that this extra thickness does not interfere with subsequent use of the crimping ring, particularly during the crimping operation.

FIGS. 18 and 19 show certain steps of the method of obtaining the crimping ring. FIG. 18 shows a continuous metal strip 410 having a group A constituted by the connection means 412A at a first end of a piece of strip together with the connection means 414A at the second end of an adjacent piece of strip formed simultaneously by a stamping and/or embossing operation. Thereafter, these two pieces of strip are separated along the line 413 which marks the boundary between the two connection means 412A and 414A. By way of example, these connection means can be analogous to those shown in FIG. 1. It has been found that during the stamping and/or embossing operation, the metal of the strip is pressed out from the sides of the ends 412A and 414A. This pressed-out material can be used to form fins analogous to the fins 319A and 319B, or it can be preferable to remove them subsequently so as to obtain pieces of strip of the kind shown in FIG. 1. Naturally, during the same stamping and/or embossing operation, it is possible to form a step of the type constituted by the step 321, particularly when it is desired to retain the fins. At a given distance from the group A, another group A1 is formed that likewise comprises a first connection means 412A1 for another piece of strip and a second connection means 414A1 which, once separated from the end 412A1 by cutting along the line 415, will serve for connecting the crimping ring made from the piece of strip B, which piece of strip has connection means 412A and 414A1. By way of example, the group A1 is shown as having another variant disposition of pressed-out matter obtained during the stamping and/or embossing operation. Excess matter in the pressed-out portions can be eliminated prior to cutting out the pieces of strip along the lines 413 and 415, or otherwise, and indeed it is possible not to eliminate excess matter until after the strip has been rolled up.

What is claimed is:

1. A crimping ring comprising a rolled-up piece of metal strip (10) whose two ends (12, 14; 52, 54; 112, 114; 152, 154; 212, 214; 252, 254; 312, 314) include respective first and second connection means that co-operate with each other to interconnect said ends, the ring being characterized in that the first connection means comprise a first overlap surface (16, 56, 116, 156, 256, 316) formed in the first end of the piece of strip as a setback from the first face of said piece of strip, together with at least one female member (18, 58, 118A, 118B, 158, 218, 258, 318) recessed from said first overlap surface, while the second connection means comprises a second overlap surface (20, 60, 120, 260) formed in the second end of the piece of strip as a setback from the second face of said piece of strip, together with a male member (22, 62, 122A, 122B, 162, 222, 262, 312) projecting from said second overlap surface, and in that the male member is engaged in the female member and fixed thereto while the overlap surfaces are placed one against the other so as to define a connection zone whose thickness (EZ) is substantially equal to the thickness (E) of the main portion of the piece of strip.

2. A crimping ring according to claim 1, characterized in that each of the first and second connection means (112, 114) has at least one female member (118A, 118B, 115A, 115B) and at least one male member (113A, 113B, 122A, 122B).

3. A crimping ring according to claim 2, characterized in that the first connection means (112, 12') when seen from the first face of the piece of strip (110A) is identical 35 to the second connection means (114, 14') when seen from the second face (110B) of the piece of strip (110).

4. A crimping ring according to claim 1 or claim 2, characterized in that at least one of the first and second overlap surfaces (16, 20; 116, 120) is formed in a setback which has a wedging rim (16A, 20A; 113'A, 113'B), while the outline of the other one of the overlap surfaces presents a wedging edge (12A, 14A; 115'A, 115'B) co-operating with said rim to oppose forces directed transversely relative to the piece of strip (10).

5. A crimping ring according to any one of claims 1 to 4, characterized in that the female member (18, 118A, 118B, 218) is formed by a through opening in the piece of strip (10) extending from the first overlap surface (16, 116).

6. A crimping ring according to claim 5, characterized in that the female member is formed by a notch (115A, 115B, 118A, 118B) made in an edge of the first end of the piece of strip.

7. A crimping ring according to any one of claims 1 to 6, characterized in that one of the first and second ends has a step (321) in its face (310A) remote from its face including the overlap surface (320), while the other one (312) of said first and second ends has side fins (319A, 319B) that are folded over into said step.

8. A method of manufacturing a crimping ring in which first and second connection means (12, 14; 52, 54; 112, 114; 152, 154; 212, 214; 252, 254; 312, 314) are formed respectively at the first and second ends of a piece of metal strip (10), and in which these ends are connected together by making said first and second connection means co-operate with each other, the method being characterized in that a first setback is formed in the first end of the piece of strip from the first face thereof, the surface of the first setback defining a first overlap surface (16, 56, 116, 156, 256, 316), at least one female member (18, 58, 118A, 118B, 158, 218, 258, 318) is recessed from said first overlap surface, a second setback is formed in the second end of the piece of strip from the second face thereof, the surface of this second setback defining a second overlap surface (20, 60, 120, 160, 260), at least one male member (22, 62, 122A, 122B, 162, 222, 262, 312) is formed to project from said second overlap surface, the overlap surfaces are placed one against the other, the male member is engaged in the female member, and said male member is fixed to said female member, and in that the first and second setbacks are made in such a manner that the thickness (EZ) of the ring in the connection zone defined by the overlap surfaces disposed one against the other is substantially equal to the thickness (E) of the main portion of the piece of strip.

9. A method according to claim 8, characterized in that the piece of strip is obtained by being cut out from a continuous strip (410) and in that the piece of strip is cut out prior to the first and second connection means being formed.

10. A method according to claim 8, characterized in that the piece of strip is obtained by being cut out from a continuous strip (410), and in that prior to separating a first piece of strip from a following piece of strip by cutting (413, 415), the second connection means (414A) of a first ring is formed at the second end of the first piece of strip that is to constitute said first ring, and a first connection means (412A) of another ring is formed at the first end of the following piece of strip that is to make said other ring, and in that said pieces of strip are then separated by cutting (413) the strip between said first and second connection means.

11. A method according to claim 8 or claim 9, characterized in that after at least the first connection means (252) has been formed with the first overlap surface (256) and the female member (258), said first overlap surface (256) is placed against the second end of the piece of strip and pressure is applied in the region of the overlapping ends of the piece of strip to cause the material (2621) of the second end of the piece of strip to be pressed out and to emboss a male member (262) into said female member.

12. A method according to claim 11, characterized in that the first connection means (252) is formed with the first overlap surface (256) and the female member (258), the second connection means (254) is formed with the second overlap surface (260) and the beginning of a male member (262), the first and second overlap surfaces are placed one against the other with the beginning of a male member (262) being placed in register with the female member (258) and pressure is applied to the second end (254) of the piece of strip from its face (250A) remote from the second overlap surface (260) so as to finish off forming the male member, causing it to penetrate into the female member (258).

13. A method according to any one of claims 8 to 12, characterized in that a female member (18, 118A, 118B) is formed as a through hole in the piece of strip, the ends of the strip are connected together so that a male member (22A, 122A, 122B) appears in said female member, and said male member is deformed in order to fix it to said female member.

14. A method according to any one of claims 8 to 13, characterized in that a step (321) is formed in one of the first and second ends (314) of the piece of strip, in the face (310A) of said end that is remote from its overlap surface (320), the other end (312) of the piece of strip is fitted with side fins (319A, 319B), and in that the side fins are folded over into said step.

* * * * *

UNITED STATES PATENT AND TRADEMARK OFFICE

CERTIFICATE OF CORRECTION

PATENT NO. : 6,481,061 B1
DATED : November 19, 2002
INVENTOR(S) : Michel Andre et al.

It is certified that error appears in the above-identified patent and that said Letters Patent is hereby corrected as shown below:

Column 9, line 55 - Column 12, line 24,
Please enter claims as amended

1. A crimping ring comprising a rolled-up piece of metal strip having two ends including respective first and second connection means that co-operate with each other to interconnect said ends, the first connection means comprising a first overlap surface formed in a first end of the piece of strip as a setback from a first face of said piece of strip, together with at least one female member recessed from said first overlap surface, while the second connection means comprises a second overlap surface formed in a second end of the piece of strip as a setback from a second face of said piece of strip, together with a male member projecting from said second overlap surface, and the male member being engaged in the female member and fixed thereto while the overlap surfaces are placed one against the other so as to define a connection zone having a thickness substantially equal to a thickness of a main portion of the piece of strip.
2. A crimping ring as claimed in claim 1, wherein each of the first and second connection means has at least one female member and at least one male member.
3. A crimping ring as claimed in claim 2, wherein the first connection means when seen from the first face of the piece of strip is identical to the second connection means when seen from the second face of the piece of strip.
4. A crimping ring as claimed in claim 1, wherein at least one of the first and second overlap surfaces is formed in a setback which has a wedging rim, while an outline of the other one of the overlap surfaces presents a wedging edge co-operating with said rim to oppose forces directed It is certified that error appears in the above-identified patent and that said Letters Patent is hereby corrected as shown below:

transversely relative to the piece of strip.

5. A crimping ring as claimed in claim 1, wherein the female member is formed by a through opening in the piece of strip extending from the first overlap surface.
6. A crimping ring as claimed in claim 5, wherein the female member is formed by a notch made in an edge of the first end of the piece of strip.
7. A crimping ring as claimed in claim 1, wherein one of the first and second ends has a step in a face thereof remote from another face including the overlap surface, while the other one of said first and second ends has side fins that are folded over into said step.
8. A method of manufacturing a crimping ring in which first and second connection means are formed respectively at the first and second ends of a piece of metal strip, and in which these ends are connected together by making said first and second connection means co-operate with each other, wherein a first setback is formed in the first end of the piece of strip from a first face thereof, a surface of the first setback defining a first overlap surface, at least one female member is recessed from said first overlap surface, a second setback is formed in the second end of the piece of strip from a second face thereof, a surface of this second setback defining a second overlap surface, at least one male member is formed to project from said second overlap surface, the overlap surfaces are placed one against the other, the male member is engaged in the female member, and said male member is fixed to said female member, the first and second setbacks being made in such a manner that a thickness of the ring in a connection zone defined by the overlap surfaces disposed one against the other is substantially equal to a thickness of a main portion of the piece of strip.
9. A method as claimed in claim 8, wherein the piece of strip is obtained by being cut out from a continuous strip and wherein the piece of strip is cut out prior to the first and second connection means being formed.
10. A method as claimed in claim 8, wherein the piece of strip is obtained by being cut out from a continuous strip, and wherein prior to separating a first piece of strip from a following piece of strip by cutting, the second connection means of a first ring is formed at the second end of the first piece of strip that is to constitute said first ring, and a first connection means of another ring is formed at the first end of the following piece of strip that is to make said other ring, and wherein said pieces of strip are then separated by cutting the strip between said first and second connection means.

UNITED STATES PATENT AND TRADEMARK OFFICE

CERTIFICATE OF CORRECTION

PATENT NO. : 6,481,061 B1
DATED : November 19, 2002
INVENTOR(S) : Michel Andre et al.

It is certified that error appears in the above-identified patent and that said Letters Patent is hereby corrected as shown below:

11. A method as claimed in claim 8, wherein after at least the first connection means has been formed with the first overlap surface and the female member, said first overlap surface is placed against the second end of the piece of strip and pressure is applied in the region of the overlapping ends of the piece of strip to cause material of the second end of the piece of strip to be pressed out and to emboss a male member into said female member.
12. A method as claimed in claim 11, wherein the first connection means is formed with the first overlap surface and the female member, the second connection means is formed with the second overlap surface and a beginning of a male member, the first and second overlap surfaces are placed one against the other with the beginning of a male member being placed in register with the female member and pressure is applied to the second end of the piece of strip from its face remote from the second overlap surface so as to finish off forming the male member, causing said male member to penetrate into the female member.
13. A method as claimed in claim 8, wherein a female member is formed as a through hole in the piece of strip, the ends of the strip are connected together so that a male member appears in said female member, and said male member is deformed in order to fix said male member to said female member.
14. A method as claimed in claim 8, wherein a step is formed in one of the first and second ends of the piece of strip, in the face of said end that is remote from the overlap surface, the other end of the piece of strip is fitted with side fins, and the side fins are folded over into said step.

Signed and Sealed this

Fifteenth Day of April, 2003

JAMES E. ROGAN
*Director of the United States Patent and Trademark Office*